United States Patent [19]

Chappell

[11] Patent Number: 4,790,043

[45] Date of Patent: Dec. 13, 1988

[54] PROCESS AND APPARATUS FOR APPLYING A CHEMICAL TO A TEXTILE SUBSTRATE

[75] Inventor: Joseph S. Chappell, Dalton, Ga.

[73] Assignee: Ciba-Geigy Corporation, Ardsley, N.Y.

[21] Appl. No.: 8,131

[22] Filed: Jan. 21, 1987

Related U.S. Application Data

[63] Continuation of Ser. No. 620,341, Jun. 13, 1984, abandoned, which is a continuation-in-part of Ser. No. 536,761, Sep. 27, 1983, abandoned.

[51] Int. Cl.[4] ..... D06B 5/02

[52] U.S. Cl. ..... 8/151; 8/158; 8/641; 8/924

[58] Field of Search ..... 8/641, 924

[56] References Cited

U.S. PATENT DOCUMENTS

| | | | |
|---|---|---|---|
| 3,706,526 | 12/1972 | Swidler et al. | 8/149.2 X |
| 3,785,179 | 1/1974 | Davis et al. | 68/205 R |
| 3,795,479 | 3/1974 | Feess et al. | 8/149.2 X |
| 3,983,723 | 10/1976 | Ameling | 68/5 E |
| 4,005,500 | 2/1977 | Rayment | 8/149.1 |
| 4,141,231 | 2/1979 | Kudlich | 68/205 R |
| 4,218,900 | 8/1980 | Caplan et al. | 68/205 R |
| 4,338,361 | 7/1982 | Lin | 68/5 D X |
| 4,351,076 | 9/1982 | Eltz et al. | 8/149.2 X |
| 4,361,019 | 11/1982 | Maund | 68/62 |
| 4,379,353 | 4/1983 | Holderer et al. | 8/149.1 |
| 4,402,704 | 9/1983 | Raisin et al. | 8/641 |
| 4,445,905 | 5/1984 | Schaetzer et al. | 8/641 |
| 4,448,582 | 5/1984 | Johnson | 8/149.1 |
| 4,485,508 | 12/1984 | Otting . | |
| 4,652,269 | 3/1987 | Bowles et al. | 8/641 |
| 4,693,727 | 9/1987 | Bowles et al. | 8/549 |

FOREIGN PATENT DOCUMENTS

| | | | |
|---|---|---|---|
| 2280744 | 2/1976 | France . | |
| 2328359 | 5/1977 | France . | |
| 2429288 | 1/1980 | France . | |
| 61493 | 5/1980 | Japan | 68/5 D |
| 1241820 | 8/1971 | United Kingdom . | |
| 2023193 | 12/1979 | United Kingdom . | |

OTHER PUBLICATIONS

European Search Report, Dated Aug. 17, 1987.

*Primary Examiner*—Harvey C. Hornsby
*Assistant Examiner*—Frankie L. Stinson
*Attorney, Agent, or Firm*—Kevin T. Mansfield; Edward McC. Roberts

[57] ABSTRACT

A chemical, such as a dye, is applied to a textile substrate, such as carpet, by continuously moving the substrate past an application position. At the application position a liquid formulation containing the chemical, heated to a temperature below the boiling point thereof, is sprayed toward the substrate, thereby driving the chemical into the substrate. The temperature of the spray is controlled such that the dye contacts the substrate at a temperature sufficient to achieve substantially instantaneous fixation.

11 Claims, 3 Drawing Sheets

PROCESS AND APPARATUS FOR APPLYING A CHEMICAL TO A TEXTILE SUBSTRATE

This application is a continuation, of now abandoned application Ser. No. 620,341, filed June 13, 1984, which is a continuation-in-part of abandoned application Ser. No. 536,761, filed Sept. 27, 1983.

BACKGROUND OF THE INVENTION

The present invention relates to a process and apparatus for applying a chemical to a textile substrate. More particularly, the present invention is directed to a process and apparatus for applying a dye to a continuous length of a textile substrate such as carpet, and such as made from a natural polyamide material, such as wool, or a synthetic polyamide material, such as nylon.

Conventional systems for dyeing textile substrates such as carpet involve the application of the dye, by various processes, to the carpet, followed by passing the dyed carpet through a steamer to achieve fixation of the dye to the carpet. Conventional steamers have to be of a length sufficient to enable treatment of the dyed carpet for a sufficient time to achieve fixation. The residence time of a given carpet section generally is from approximately 4 to approximately 15 minutes. Since the carpet passes through the dyeing machine at a relatively high speed, for example up to approximately 30 yards a minute and even higher, these steamers must have a quite long length, even when the steaming path undulates. Typically, steamers are of a length of 100 to 300 feet, and even longer. It will be apparent that the cost of providing and operating such steamers is quite high. Thus, the energy costs to maintain steam in such large enclosures is high. Furthermore, maintenance costs as well as initial capital costs are high. Even further, the cost of the large amount of factory space required for such steamers is high.

Furthermore, various attempts have been made to improve conventional dyeing procedures, and specifically to improve the quality and reproducibility of dyeing operations.

One system, the so-called "Otting" system sprays the dye onto the carpet with the aid of air and then heats the dyed carpet. This system still however requires the use of a steamer.

Another system, the so-called "Artos" system, passes the carpet through a bath of dye liquor heated to a boiling point temperature. After the carpet passes through the dye bath, the carpet is rinsed and then dried.

Another system is the so-called "PRINTAIRE" system wherein dye is applied to the carpet by creating a foam which is applied to the carpet. The thus dyed carpet then is passed through a steamer.

All of the above prior art systems are expensive, both in initial investment and in operating cost.

SUMMARY OF THE INVENTION

With the above discussion in mind, it is an object of the present invention to provide a novel process and apparatus for applying a chemical to a textile substrate whereby it is possible to overcome the above and other prior art disadvantages.

A further object of the present invention is to provide a process and apparatus which requires a much lower capital investment than known systems and which may be operated much less expensively than known systems, particularly from the viewpoint of energy costs.

A more specific object of the present invention is to provide a novel process and apparatus for dyeing carpet, particularly for applying an acid dye to a natural or synthetic polyamide carpet.

These objects are achieved in accordance with the present invention by continuously moving a substrate past an application position or station, and at such application position or station spraying a heated liquid formulation toward the substrate, thereby driving the chemical to be applied into the substrate and simultaneously fixing it.

In accordance with a preferred arrangement of the present invention, the chemical comprises a dye. The textile substrate comprises a natural or synthetic polyamide substrate, specifically carpet.

In accordance with a particularly preferred embodiment of the present invention, the temperature of the liquid is controlled such that the chemical, such as a dye, contacts the substrate, such as carpet, at a temperature sufficient to achieve substantially instantaneous fixation. In other words, according to this preferred embodiment of the present invention, the heated liquid dye formulation is driven into the textile fabric, and the liquid is heated to an extent such that the temperature of the dye as it contacts the carpet is at a sufficiently high level to achieve substantially instantaneous fixation. By "substantially instantaneous fixation" as employed herein is meant that fixation occurs within a matter of seconds of initial contact of the dye with the carpet. This temperature control may be achieved by enclosing the dye spray, and thereby preventing any substantial cooling of the dye before contact thereof with the substrate. This can be achieved by an enclosure surrounding the spray of dye. Such enclosure may also enclose that portion of the carpet substrate at the application position, i.e. the carpet substrate may be passed through the enclosure. In accordance with a modification of this arrangement, the enclosure may have therethrough, in the area of the application position, a single large opening through which passes the dye spray. The carpet substrate is caused to move in contact with the exterior of the enclosure and to pass over such opening while forming a seal of such opening, thereby maintaining an optimum reaction temperature within the enclosure. In a further alternative arrangement, the enclosure comprises a confined channel having a discharge end. The carpet substrate is caused to move across the discharge end of the channel. The exterior of the channel may be heated, for example by steam, thereby maintaining a desired temperature of the heated dye formulation.

In our copending U.S. patent application Ser. No. 536,761, filed on Sept. 27, 1983, the application of a chemical such as a dye, in a vapor carrier such as steam, to a substrate such as carpet is taught. The steam acts both as carrier of the chemical toward the substrate and provides sufficient energy to substantially instantaneously fix such chemical to the substrate. It has now been found that excellent results are often obtained if the chemical is applied from a liquid heated to near its boiling point rather than from steam vapor. This improvement results in substantial energy savings and simplifies the equipment requirements.

Dyes usable according to the invention are preferably anionic, water-soluble or at least dispersible in water. They can be reactive or preferably nonreactive, i.e. they are able or not able to form with the substrate a covalent bond, and they can belong to different classes of dyes. They are, for example, salts of metal-free or heavy-metal-containing mono-, dis- or polyazo dyes, including the formazan dyes, as well as anthraquinone, nitro, triphenylmethane and phthalocyanine dyes. Of interest are also the 1:2 metal complex dyes. The anionic character of these dyes can be caused by metal-complex formation alone and/or by acid salt-forming substituents, such as carboxylic acid groups, sulphuric acid groups and phosphoric acid ester groups, phosphoric acid groups or sulphonic acid groups.

The dyes can be used alone or in combination with one another, especially in a trichromatic system.

Advantages of the process and apparatus of the present invention include an approximately 25 percent dye savings compared with known systems, energy savings, equipment savings and space savings.

As pointed out above, the dye formulation is heated to a temperature sufficient to enable the obtaining of substantially instantaneous fixation. It is intended that such heating involve a temperature below the boiling point of the particular dye formulation. In other words, the formulation is heated to a temperature just below the particular flash point to steam. It is important that the formulation remains as liquid and is not vaporized. Preferred temperatures are between 190° and 212° F. Particularly preferred are temperatures between 205° and 212° F.

In most embodiments of the present invention, it is possible to eliminate wetting and afterwashing or rinsing. Where rinsing is required, it is minimized relative to the state of the art. There is no frosting, and bulking and handling are improved. Prewetting is not required.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
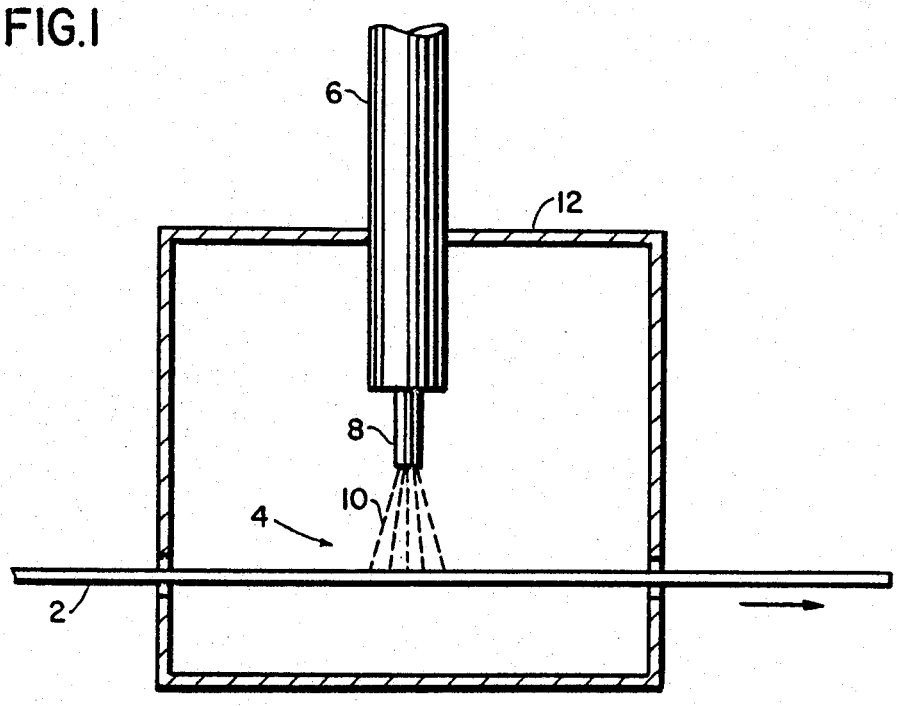
FIG. 1 through 5 are schematic, partially sectioned views illustrating various embodiments of the process and apparatus of the present invention.

In FIG. 1 there is shown a carpet 2 moved continuously in the direction indicated by the arrow by conventional moving structure. The carpet is moved past an application position or station indicated generally by 4. At station 4 there is sprayed onto the carpet a liquid dye formulation heated to a temperature below the boiling point of the liquid. Thus, the heated dye formulation is introduced through a supply conduit 6. The formulation supplied to conduit 6 may be preheated, or the exterior of the conduit may be heated, thereby to heat the dye formulation. The dye formulation is discharged from conduit 6, for example through nozzle 8 in the form of a spray 10 toward the carpet 2 at the application position 4. A nozzle 8 as such is not necesarily required, and the spray 10 may be dischargd from conduit 6 simply through an opening therein, or conduit 6 simply may be in the form of a tube having an open lower end.

In accordance with a novel feature of the present invention, the temperature of the dye spray 10 is controlled such that the dye contacts the carpet 2 at a temperature sufficient to achieve substantially instantaneous fixation. Temperature control specifically is achieved by enclosing the spray 10 by an enclosure 12. Enclosure 12 is of relatively small volume and maintains a temperature control to prevent the temperature of the dye spray 10 from substantially decreasing prior to contact with the carpet 2. The specific size of enclosure 12 is not particularly important, as long as it is small enough to achieve the above results. In actual practice, the length of enclosure 12 in the direction of movement of the carpet has been approximately 26 inches.

The application of the heated dye spray achieves two functions. Firstly, the spray of the dye essentially drives the dye into the carpet. Secondly, the heated liquid contains sufficient energy to achieve substantially instantaneous fixation of the dye to the carpet. The spacing of the nozzle 8 from the carpet, the temperature of the liquid, and the pressure of the spray supplied from nozzle 8 will vary substantially from installation to installation, depending upon the dye employed, the carpet employed, the speed of the carpet, etc. It is believed that one of ordinary skill in the art, upon considering the present disclosure, would understand how to vary these parameters while achieving performance of the present invention. It generally is believed that the spacing from the nozzle 8 to the carpet 2, according to this embodiment of the invention, may vary from one to seven inches, more preferably from approximately two and one half inches to five inches. This however is considered to be exemplary only and not in any way limiting to the scope of the present invention. Such spacing obviously must be not so great so as to prevent the dye spray from being driven into the carpet. Furthermore, the pressure of the dye spray must be sufficient to achieve such driving force. Additionally, the particular temperature of the dye formulation supplied to conduit 6 and also the temperature of the dye spray as it contacts the carpet will vary from situation to situation, depending on a number of parameters, for example the dye employed and the carpet employed. It is believed that those skilled in the art would understand how to achieve the substantially instantaneously fixation of the present invention for a particular dye and a particular carpet.

The above discussion has been with regard to the application of a dye to a carpet. The present invention particularly is suitable for the application of an acid dye to a polyamide carpet, for example a natural polyamide such as wool, or a synthetic polyamide such as nylon. It is believed that the heat of the dye spray 10 opens up cavities, and that this diffusion is enhanced by the polar attraction of the acid dye to the polyamide material. It is believed that the process and apparatus of the present invention could be employable with dispersed dyes and/or polyester substrate materials, but this probably would required additional steaming.

Certain dyes which are of particular interest in carrying out the present invention are:

azo dyes of the formula

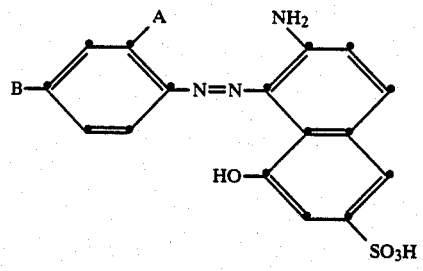

wherein A is hydrogen, unsubstituted or substituted alkyl, —C—$NR_2$, —$SO_2NR_2$, —$SO_2R$, wherein R is alkyl, cycloalkyl, aryl and aryloxy, and B is hydrogen, halogen, alkanoylamino, alkoxycarbonylamino, alkylsulfonylamino or arylsulfonylamino;

anthraquinone dyes of the formula

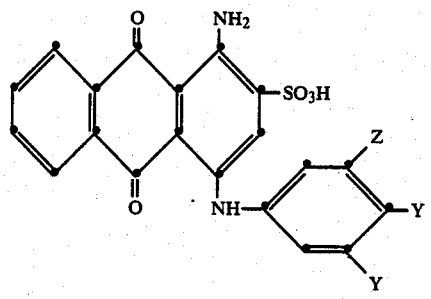

wherein one Y is hydrogen or alkyl and the other is alkanoylamino or hydroxyalkylsulfamoyl and Z is hydrogen or alkyl;

azo dyes of the formulae

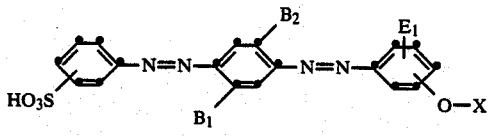

and

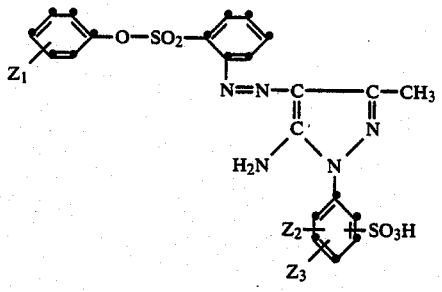

wherein $B_1$, $B_2$ and $E_1$ are hydrogen, $C_1$–$C_4$-alkyl or $C_1$–$C_4$-alkoxy, and X is straight-chain or branched-chain $C_1$–$C_4$alkyl, or straight-chain or branched-chain $C_2$–$C_4$-hydroxyalkyl, and each of $Z_1$, $Z_2$ and $Z_4$ independently of the other is hydrogen, halogen, $C_1$–$C_4$ alkyl or $C_1$–$C_4$ alkoxy;

1:2 cobalt complex dyes of the formula

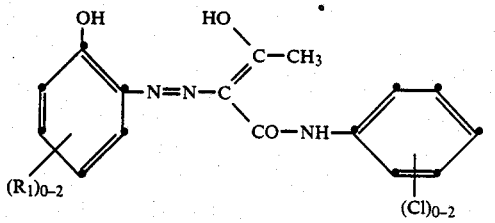

in which $(R_1)_{0-2}$ represents 0 to 2 substituents $R_1$ which, independently of each other, can be $C_{1-4}$-alkyl, $C_{1-4}$-alkoxy, halogen, nitro, sulfo, sulfamoyl, N-$C_{1-4}$-alkylsulfamoyl, N-$C_{1-2}$-alkoxy-$C_{1-2}$-alkylsulfamoy, phenylaminosulfonyl, carboxyphenylaminosulfonyl, $C_{1-4}$-alkylsulfonyl or acetylamino;

1:2 chromium complex or 1:2 cobalt complex dyes of the formula

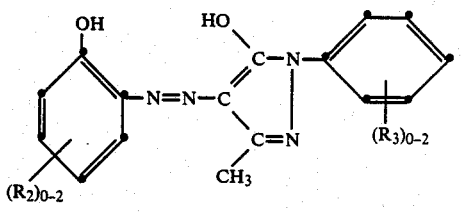

in which $R_2$ is defined in the same way as $R_1$ in the previous formula, and $(R_3)$0-2 represents 0 to 2 substituents $R_3$ which, independently of each other, can be halogen or sulfamoyl;

1:2 cobalt complex or 1:2 chromium complex dyes of the formula

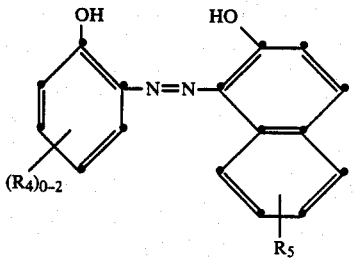

in which $R_4$ is defined in the same way as $R_1$ in the prior formula and $R_5$ is hydrogen, acetylamino, methoxycarbonylamino or methylsulfonylamino;

1:2 cobalt or 1:2 chromium complex dyes of the formula

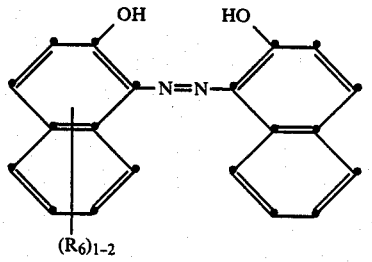

in which $(R_6)_{1-2}$ represents 1 to 2 substituents $R_6$ which, independently of each other, can be sulfo or nitro;

1:2 chromium complex dyes of the formula

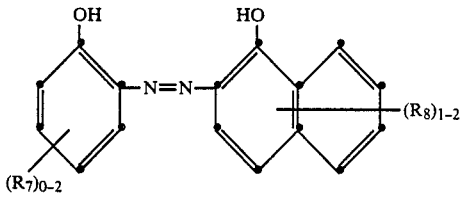

in which $R_7$ is defined in the same way as $R_1$ in the prior formula, and $(R_8)_{1-2}$ represents 1 to 2 substituents $R_8$ which, independently of each other, can be halogen, methyl or sulfo, or in which 2 adjacent substituents $R_8$ can form a closed bridge member $—SO_2—CH2—O—$;

1:2 cobalt or 1:2 chromium complex dyes of the formula

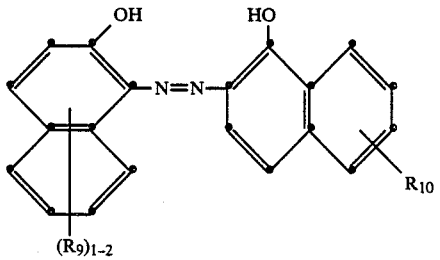

in which $R_9$ is defined in the same way as $R_6$ in a prior formula, and $R_{10}$ is hydrogen or hydroxyl;

dyes of the formula

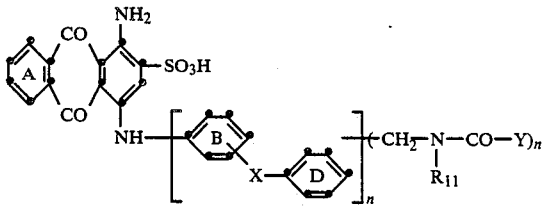

in which X is oxygen or sulfur, $R_{11}$ is hydrogen or $C_{1-4}$-alkyl, Y is substituted or unsubstituted aryl radical, and n is 1, 2 or 3, the benzene ring A can be substituted by halogen, and the benzene rings B and D, independently of each other, can be substituted by halogen, $C_{1-4}$-alkyl, $C_{1-4}$-alkoxy or a radical of the formula $—(O—CH_2CH_2—)—O—R_{12}$ in which $R_{12}$ is hydrogen, methyl or ethyl;

dyes of the formula

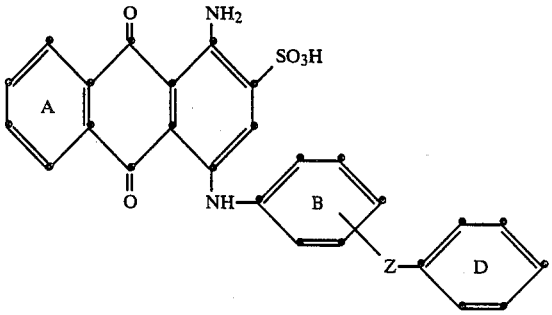

in which Z is $—O—SO_2—$, $—NH—SO_2—$, $—NH—CO—$ and the phenyl rings A, B and D can be substituted as given in the previous formula;

1:2 cobalt complex dyes of the formula

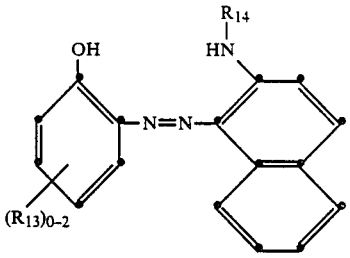

in which $R_{13}$ is defined in the same way as $R_1$ in the first formula, and $R_{14}$ is hydrogen or phenyl;

1:2 chromium complex dyes of the formula

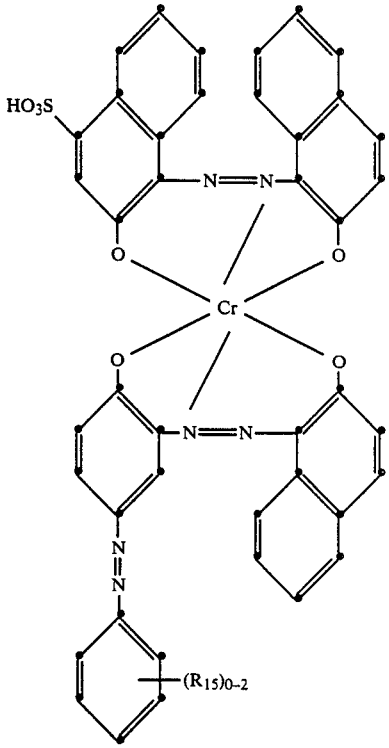

in which $(R_{15})_{0-2}$ represents 0 to 2 substituents $R_{15}$ which, independently of each other, can be $C_{1-4}$-alkyl, $C_{1-4}$-alkoxy, halogen, carboxyl or sulfo; and 1:2 chromium mixed complex dyes of the formula

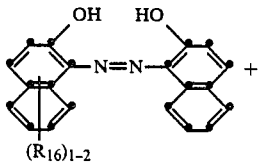

1:1 chromium complex

-continued

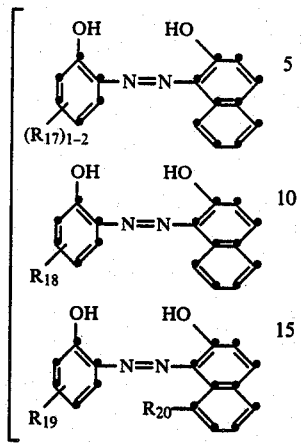

in which $(R_{16})_{1-2}$ represents 1 to 2 substituents $R_{16}$ which, independently of each other, can be sulfo or nitro, $(R_{17})_{-1-2}$ represents 1 to 2 substituents $R_{17}$ which, independently of each other, can be nitro, halogen, methyl or acetylamino, $R_{18}$ is defined in the same way as $R_{17}$ and independently of the latter, $R_{19}$ is defined in the same way as $R_{17}$ and independently of the latter, and $R_{20}$ is acetylamino, methoxycarbonylamino, ethoxycarbonylamino, methylsulfonylamino or N,N-dimethylaminosulfonyl.

Specific examples of dyes which are preferred for use according to the instant invention are the red azo dyes of the formulae

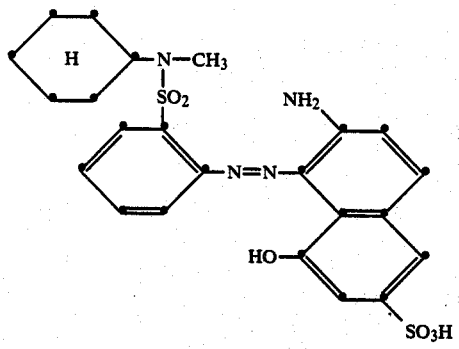

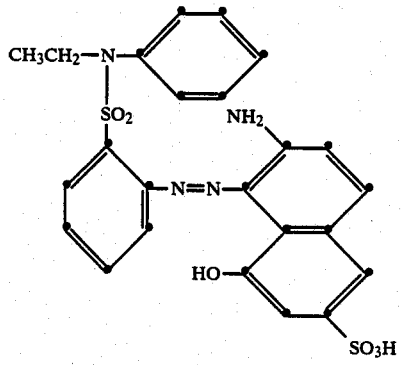

-continued

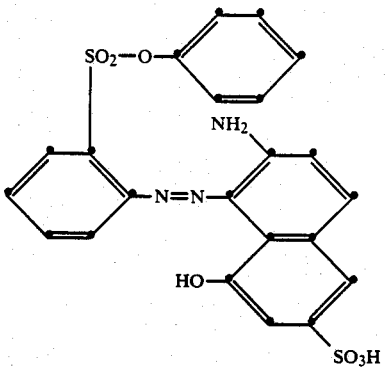

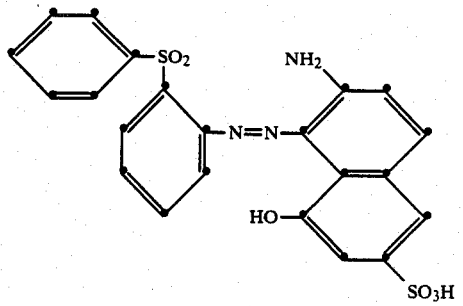

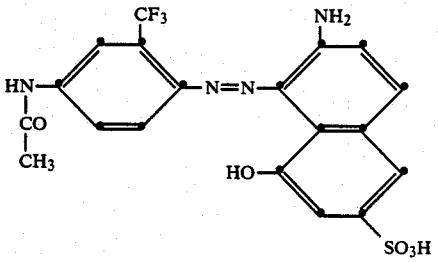

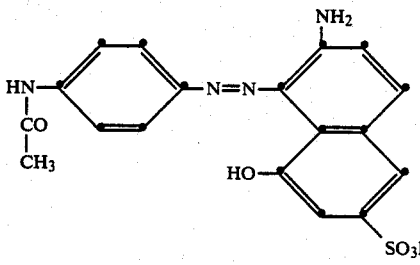

and

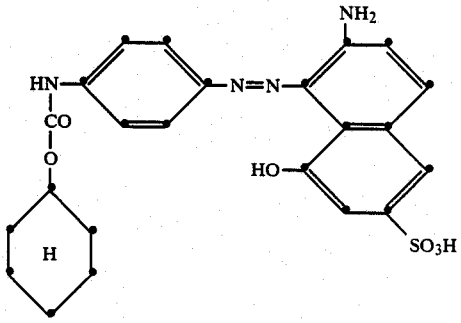

a mixture of 20 parts of the red dye

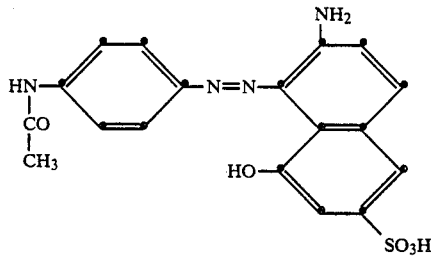
and 80 parts of the red dye
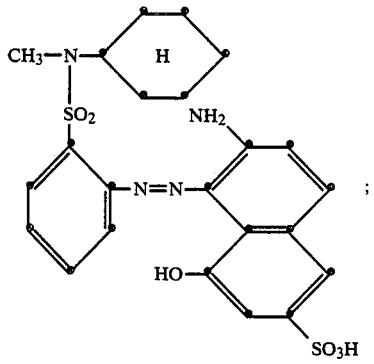
;
a mixture of 20 parts of the red dye
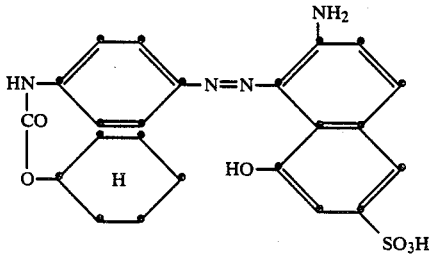
and 80 parts of the red dye
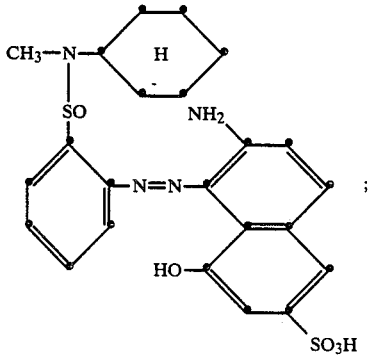
;
a mixture of 50 parts of the red dye
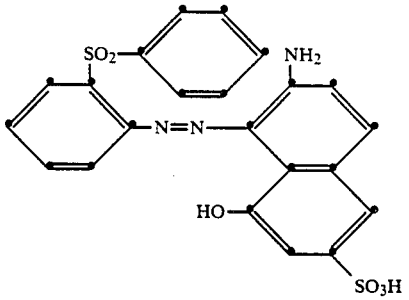
and 50 parts of the red dye
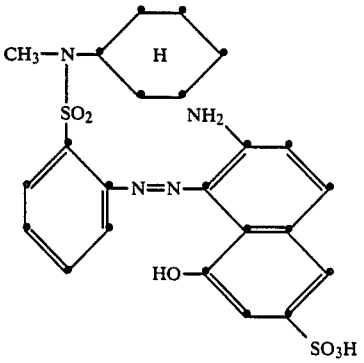
;
a mixture of 50 parts of the red dye
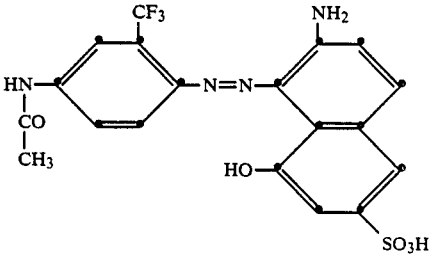
and 50 parts of the red dye
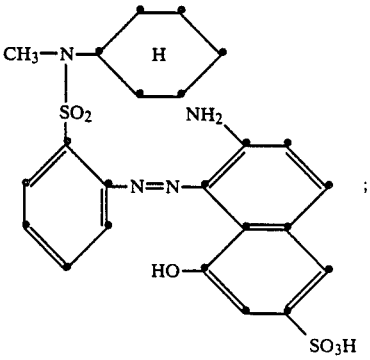
;
a mixture of 30 parts of the red dye

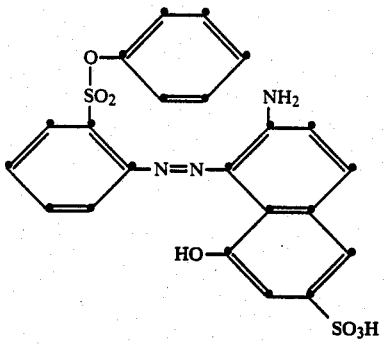
and 70 parts of the red dye
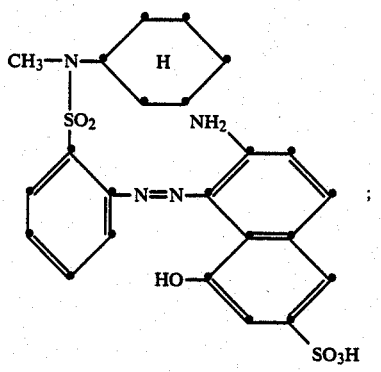
The orange dye of the formula
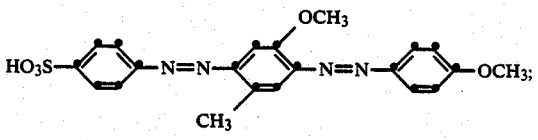
The yellow dyes of the formulae
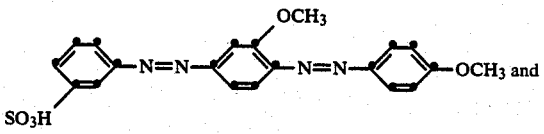
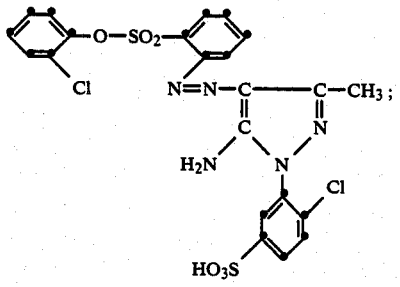
blue anthroquinone dyes of the formulae
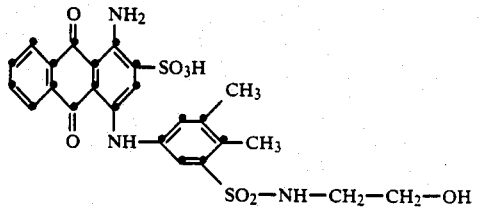
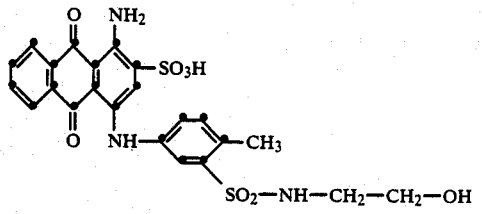
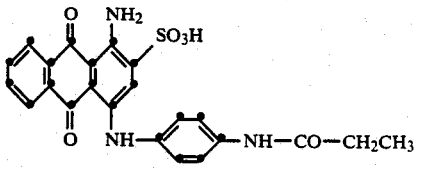
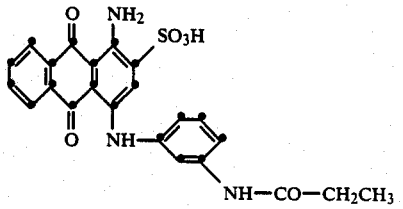
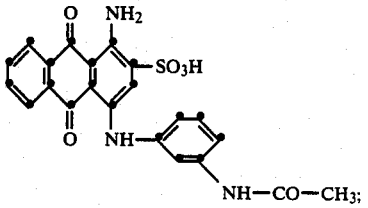
and metal complex dyes such as the yellow 1:2 cobalt complex of
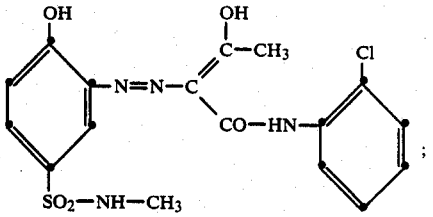
the bordeaux 1:2 cobalt complex of
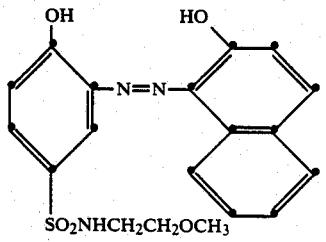

and the black dye obtained on mixing

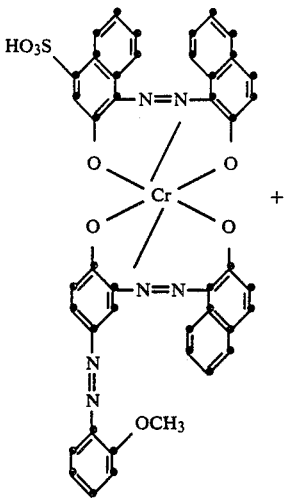

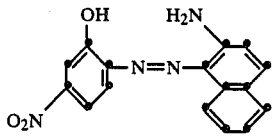

1:2 cobalt complex.

It is to be understood however that the present invention is not limited to the application of a dye to a carpet, but may be employed for application of a dye to another type of textile substrate or for the application of another chemical to a carpet or other textile substrate. Specifically, it is intended that other chemicals which may be applied in accordance with the present invention are softeners, anti-static chemicals, anti-soiling chemicals, waterproofing chemicals, anti-microbial chemicals, etc. Furthermore, it is contemplated that the present invention add any of the above chemicals, or other chemicals, along with a dye.

It is to be understood that the carpet 2 has a substantial dimension in a direction into the plane of the figure. Accordingly, the apparatus of the present invention also will have a corresponding dimension in such direction. This may be by providing several conduits 6 spaced in such dimension, i.e. across the width of the carpet. Alternatively, the apparatus shown in FIG. 1 could extend entirely across the width of the carpet.

Figure 2:
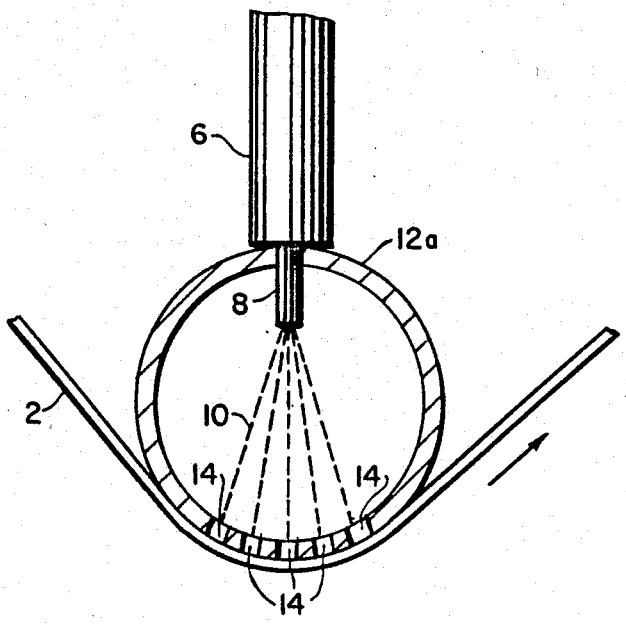

FIG. 2 illustrates a modification of the embodiment of FIG. 1. Thus, whereas in FIG. 1 the carpet 2 passes through the enclosure 12, in the embodiment of FIG. 2 the carpet passes around a portion of the periphery of an enclosure **12*b* which has therethrough, in the area of the application station, a single large opening 16. The carpet 2 is caused to move over the exterior of enclosure 12*b* and across opening 16 to form a seal of the opening. Thus, the dye spray 10 passes through opening 16 to dye the carpet 2 moving therepast, and the carpet seals opening 16 to avoid any loss of temperature control within enclosure 12*b***.

Figure 3:
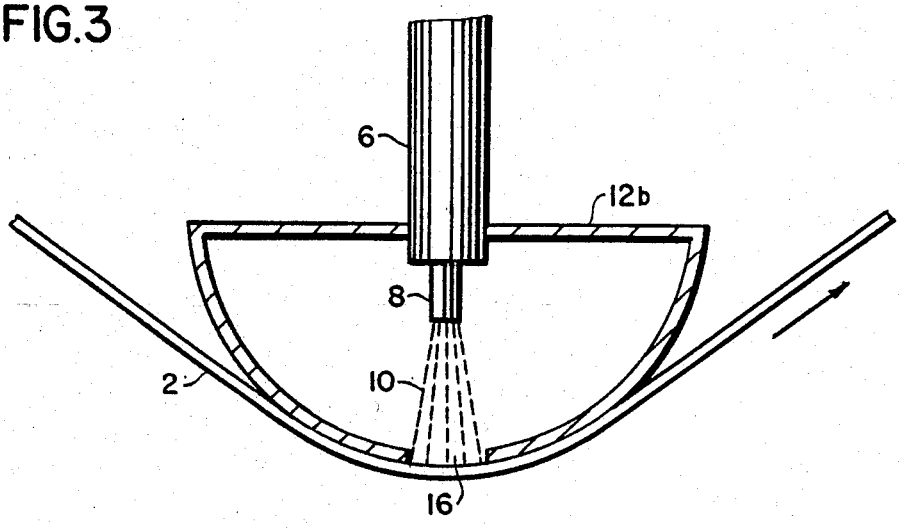
Figure 4:
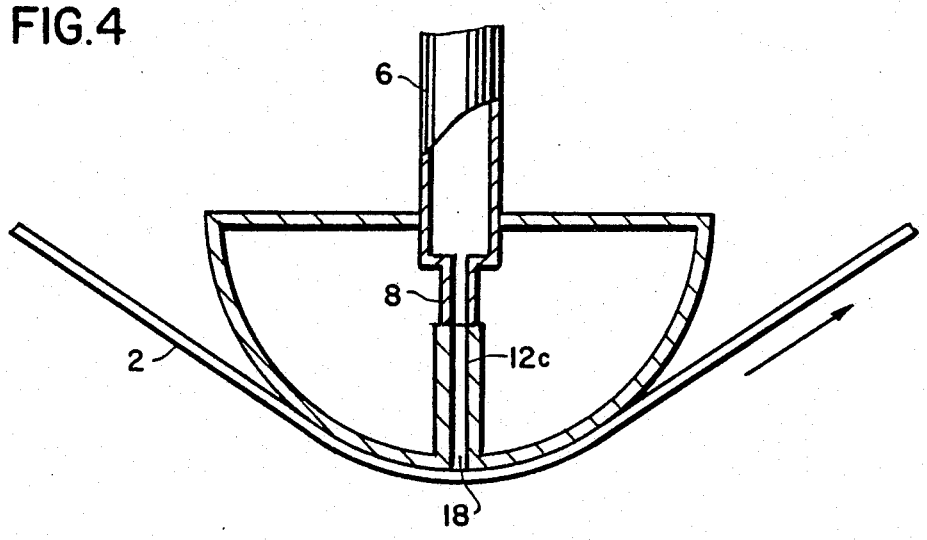
Figure 5:
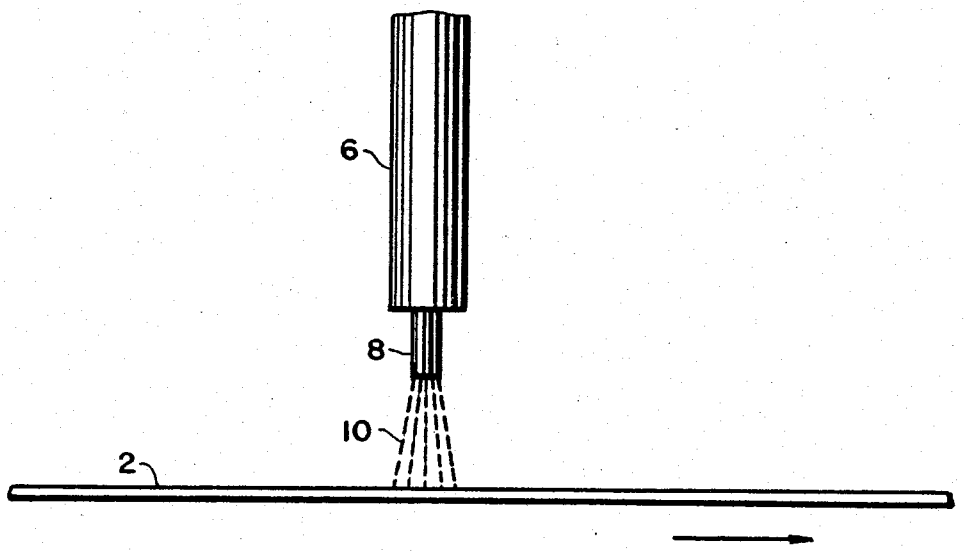

FIG. 3 illustrates a further embodiment of the present invention, and specifically a modification of the embodiment of FIG. 2. Thus, in accordance with this embodiment of the present invention, the enclosure may be in the form of a confined channel leading from the conduit 6 or the nozzle 8 and having a discharge end 18. The substrate 2 is caused to move across the discharge end 18, whereby the dye formulation is sprayed onto the substrate. FIG. 3 illustrates the arrangement as being somewhat of a modification of the structure shown in FIG. 2, but this merely is to indicate the provision of a curved surface across which the substrate moves. Any other configuration may be employed, as will be apparent to those skilled in the art. One possible advantage of the use of the structure shown in FIG. 3 is that the interior of the casing surrounding channel **12*c*** may be supplied with steam to maintain the desired temperature of the dye spray.

EXAMPLE 1

A dye liquor is heated to 205°–208° F. and sprayed at 45 psi through a row of nozzles onto a nylon 66 carpet as the carpet moves continuously through an enclosure of the type shown in FIG. 1. The residence time of the carpet within the enclosure is of the order of 5 seconds and is adjusted as needed to obtain a 500% pick-up of the dye formulation.

The following dye formulations were employed:

FORMULATION 1

0.150 g/l Tectilon Orange 3GV 200% (C.I. Acid Orange 156)
0.100 g/l Tectilon Red 2BV 200% (C.I. Acid Red 361)
0.125 g/l Tectilon Blue 4RV 200% (C.I. Acid Blue 277)
2.000 g/l Irgapadol WF (ammonium sulfate ester of ethoxylated nonylphenol)
0.500 g/l Silvatol NP (ethoxylated nonylphenol)
Formic acid as needed to adjust pH to 4.0.

FORMULATION 2

0.30 g/l Tectilon Orange 3GV 200% (C.I. Acid Orange 156)
0.20 g/l Tectilon Red 2BV 200% (C.I. Acid Red 361)
0.25 g/l Tectilon Blue 4RV 200% (C.I. Acid Blue 277)
2.00 g/l Irgapadol WF (ammonium sulfate ester of ethoxylated nonylphenol)
0.50 g/l Silvatol NP (ethoxylated nonylphenol)
Formic acid as needed to adjust pH to 4.0.

FORMULATION 3

0.35 g/l Tectilon Orange 3GV 200% (C.I. Acid Orange 156)
0.35 g/l Tectilon Red 2BV 200% (C.I. Acid Red 361)
0.10 g/l Tectilon Blue 4RV 200% (C.I. Acid Blue 277)
2.00 g/l Irgapadol WF (ammonium sulfate ester of ethoxylated monylphenol)
0.50 g/l Silvatol NP (ethoxylated nonylphenol)
Formic acid as needed to adjust pH to 4.0.

There is obtained with each formulation good dye fixation.

By adjusting the pH to 8–10 with trisodium phosphate instead of to 4.0, similar good results can be obtained on nylon 6 carpets with the above formulations.

EXAMPLE 2

Using the conditions of example 1, a nylon 66 carpet was sprayed with the following formulation:

FORMULATION 0.480 g/l Irgalan Yellow 3RL KWL 250 (C.I. Acid Orange 162)
0.046 g/l Irgalan Bardeaux GRL K 200 (C.I. Acid Red 213)
0.176 g/l Irgalan Black GBL 200

2.000 g/l Irgapadol WF (ammonium sulfate ester of ethoxylated nonylphenol)
0.500 g/l Silvatol NP (ethoxylated nonylphenol)
Formic acid as needed to adjust pH to 4.0.
Again good dye fixation was obtained.

EXAMPLE 3

Using Formulation 1 of Example 1 and the conditions of that example, but with the pH adjusted to 3.0 with formic acid, a wool carpet was similarly sprayed with dye solution. Again good dye fixation was obtained.

Although the present invention has been described and illustrated with respect to preferred embodiments thereof, it is to be understood that various modifications and changes may be made to the specifically described and illustrated features without departing from the scope of the present invention.

What is claimed is:

1. A continuous process for applying and simultaneously fixing an acid dye to a polyamide carpet, said process comprising:

heating a liquid formulation containing said acid dye to a temperature just below the boiling point thereof;

continuously moving said polyamide carpet past an application position; and at said application position directly spraying said heated liquid dye formulation in the absence of a gaseous carrier toward said polyamide carpet, thus driving said heated liquid dye formulation into said polyamide carpet at a temperature sufficient to achieve substantially instantaneous fixation of said dye.

2. A process as claimed in claim 1, wherein said dye comprises a metal complex acid dye.

3. A process as claimed in claim 1, wherein said polyamide carpet comprises a wool carpet.

4. A process as claimed in claim 1, wherein said polyamide carpet comprises a nylon carpet.

5. A process as claimed in claim 4, wherein said nylon carpet comprises a nylon 6 or nylon 66 carpet.

6. A process as claimed in claim 1, further comprising controlling the temperature of said heated liquid dye formulation such that said dye contacts said carpet at a temperature to achieve substantially instantaneous fixation.

7. A process as claimed in claim 6, wherein said temperature controlling comprises enclosing said dye spray, and thereby preventing substantial cooling of said dye before contact thereof with said carpet.

8. A process as claimed in claim 1, wherein a mixture of dyes is applied.

9. A continuous process for applying and simultaneously fixing a trichromatic acid dye mixture to a natural or synthetic polyamide carpet, said process comprising:

heating a liquid formulation containing said trichromatic dye mixture to a temperature just below the boiling point thereof;

continuously moving said polyamide carpet past an application position; and at said application position directly spraying said heated liquid dye formulation in the absence of a gaseous carrier toward said polyamide carpet, thus driving said heated liquid dye formulation into said polyamide carpet at a temperature sufficient to achieve substantially intantaneous fixation of said dye.

10. A process as claimed in claim 9, wherein the dyes in said mixture are selected from azo dyes of the formula I

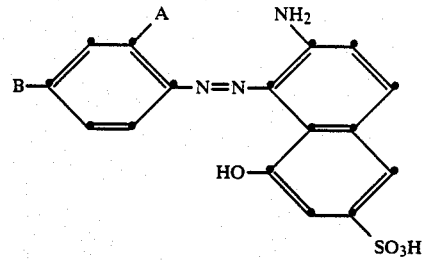

(I)

wherein A is hydrogen, unsubstituted or substituted alkyl, —C—$NR_2$, —$SO_2NR_2$, —$SO_2R$, wherein R is alkyl, cycloalkyl, aryl and aryloxy, and B is hydrogen, halogen, alkanoylamino, alkoxycarbonylamino, alkylsulfonylamino or arylsulfonylamino;

anthraquinone dyes of the formula II

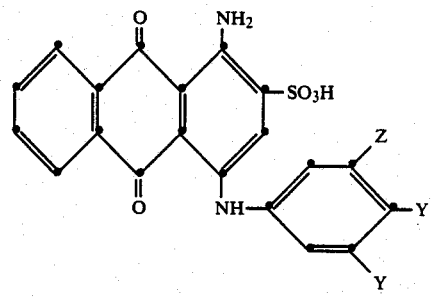

(II)

wherein one Y is hydrogen or alkyl and the other is alkanoylamino or hydroxyalkylsulfamoyl and Z is hydrogen or alkyl;

azo dyes of the formulae III and IV

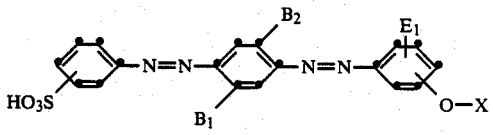

(III)

and

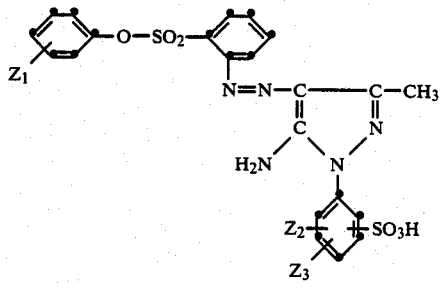

(IV)

wherein $B_1$, $B_2$ and $E_1$ are hydrogen, $C_1$–$C_4$-alkyl or $C_1$–$C_4$-alkoxy, and X is straight-chain or branched-chain $C_1$–$C_4$-alkyl, or straight-chain or branched-chain $C_2$–$C_4$-hydroxyalkyl, and each of $Z_1$, $Z_2$ and $Z_4$ independently of the other is hydrogen, halogen, $C_1$–$C_4$-alkyl or $C_1$–$C_4$-alkoxy;

1:2 cobalt complex dyes of the formula V

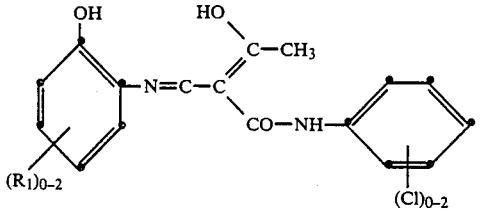

(V)

in which $(R_1)_{0-2}$ represents 0 to 2 substituents $R_1$ which, independently of each other, are $C_1$–$C_4$-alkyl, $C_1$–$C_4$-alkoxy, halogen, nitro, sulfo, sulfamoyl, N-$C_1$–$C_4$-alkylsulfamoyl, N-$C_1$–$C_2$-alkoxy-$C_1$–$C_2$-alkylsulfamoyl, phenylaminosulfonyl, carboxyphenylaminosulfonyl, $C_1$–$C_4$-alkylsulfonyl or acetylamino;

1:2 chromium complex or 1:2 cobalt complex dyes of the formula VI

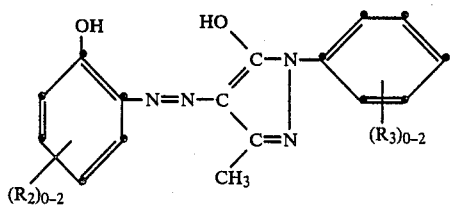

(VI)

in which $R_2$ is defined in the same way as $R_1$ of the formula V, and $(R_3)_{0-2}$ represents 0 to 2 substituents $R_3$ which, independently of each other, are halogen or sulfamoyl;

1:2 cobalt complex or 1:2 chromium complex dyes of the formula VII

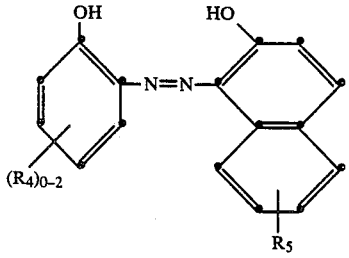

(VII)

in which $R_4$ is defined in the same way as $R_1$ of the formula V and $R_5$ is hydrogen, acetylamino, methoxycarbonylamino or methylsulfonyamino;

1:2 cobalt or 1:2 chromium complex dyes of the formula VIII

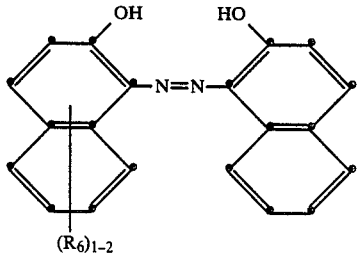

(VIII)

in which $(R_6)_{1-2}$ represents 1 to 2 substituents $R_6$ which, independently of each other, are sulfo or nitro;

1:2 chromium complex dyes of the formula IX

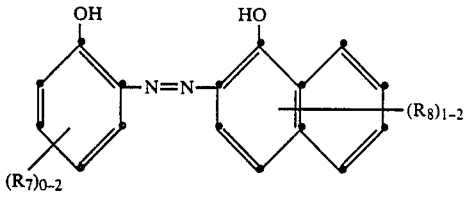

(IX)

in which $R_7$ is defined in the same way as $R_1$ of the formula V, and $(R_8)_{1-2}$ represents 1 to 2 substituents $R_8$ which, independently of each other, are halogen, methyl or sulfo, or in which 2 adjacent substituents $R_8$ form a closed bridge member —SO-$_2$—$CH_2$—O—;

1:2 cobalt or 1:2 chromium complex dyes of the formula X

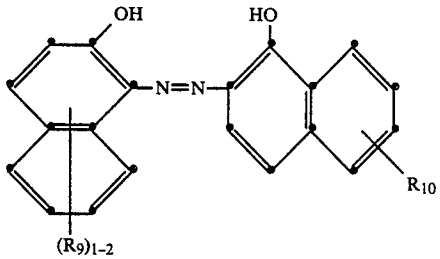

(X)

in which $R_9$ is defined in the same way as $R_6$ of the formula VIII and $R_{10}$ is hydrogen or hydroxyl;

dyes of the formula XI

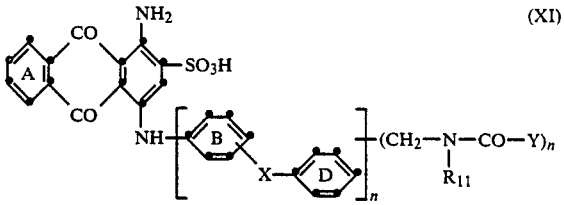

(XI)

in which X is oxygen or sulfur, $R_{11}$ is hydrogen or $C_1$–$C_4$-alkyl, Y is a substituted or unsubstituted aryl radical, and n is 1, 2 or 3, the benzene ring A is unsubstituted or substituted by halogen, and the benzene rings B and D, independently of each other, are unsubstituted or substituted by halogen, $C_1$–$C_4$-alkyl, $C_1$–$C_4$-alkoxy or a radical of the formula —(O—$CH_2CH_2$—)—O—$R_{12}$ in which $R_{12}$ is hydrogen, methyl or ethyl;

dyes of the formula XII

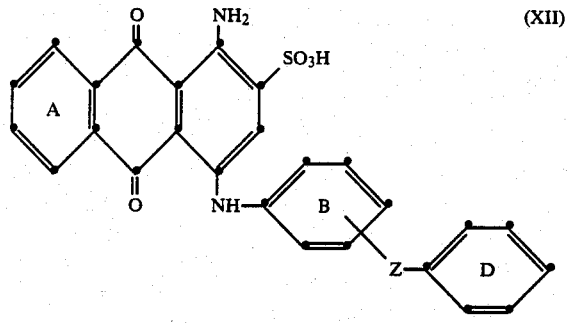

(XII)

in which Z is —O—$SO_2$—, —NH—$SO_2$—, —NH—CO— and the phenyl rings A, B and D are unsubstituted or substituted as in A, B and D of the formula XI;

1:2 cobalt complex dyes of the formula XIII

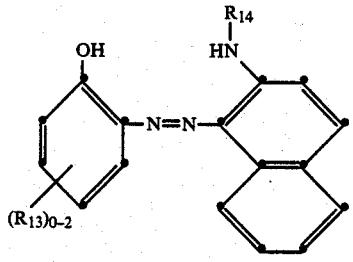

(XIII)

in which $R_{13}$ is defined in the same way as $R_1$ of formula V, and $R_{14}$ is hydrogen or phenyl;

1:2 chromium complex dyes of the formula XIV

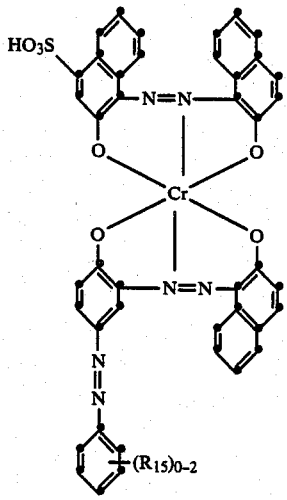

(XIV)

in which $(R_{15})_{0-2}$ represents 0 to 2 substituents $R_{15}$ which, independently of each other, are $C_1$–$C_4$-alkyl, $C_1$–$C_4$-alkoxy, halogen, carboxyl or sulfo; and 1:2 chromium mixed complex dyes of the formula XV

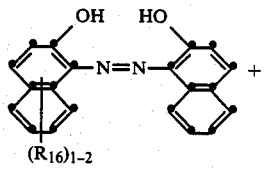

1:1 chromium complex

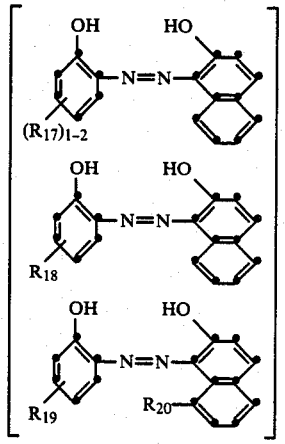

in which $(R_{16})_{1-2}$ represents 1 to 2 substituents $R_{16}$ which, independently of each other, are sulfo or nitro, $(R_{17})_{1-2}$ represents 1 to 2 substituents $R_{17}$ which, independently of each other, are nitro, halogen, methyl or acetylamino, $R_{18}$ is defined in the same way as $R_{17}$ and independently of the latter, $R_{19}$ is defined in the same way as $R_{17}$ and independently of the latter, and $R_{20}$ is acetylamino, methoxycarbonylamino, ethoxycarbonylamino, methylsulfonylamino or N,N-dimethylaminosulfonyl.

11. A process as claimed in claim 10, wherein the mixture comprises at least one red dye, one yellow or orange dye and one blue dye, said dyes being selected from the red azo dyes of the formulae

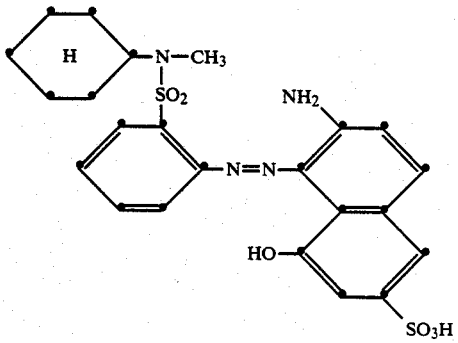

-continued
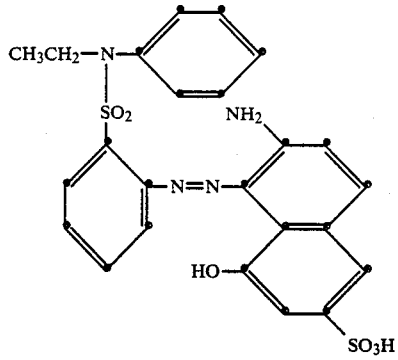
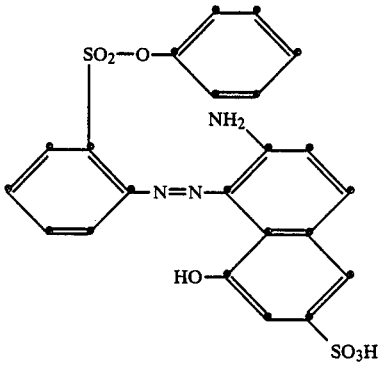
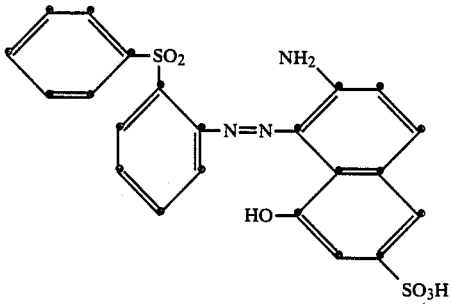
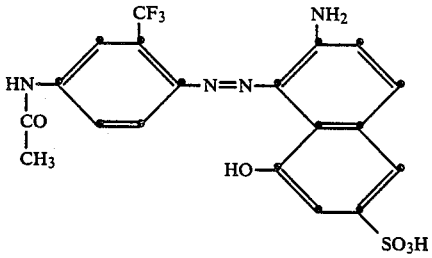
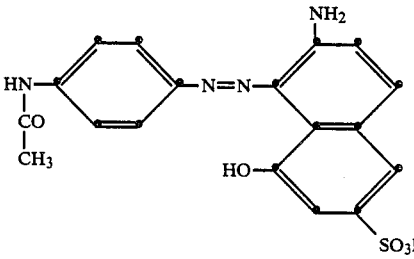
and
-continued
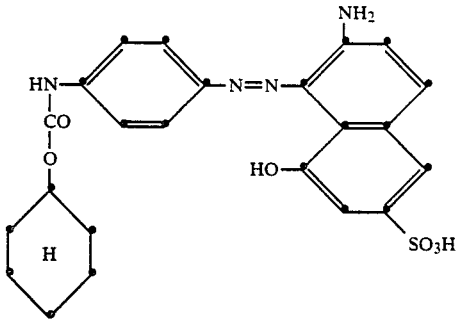
a mixture of 20 parts of the red dye
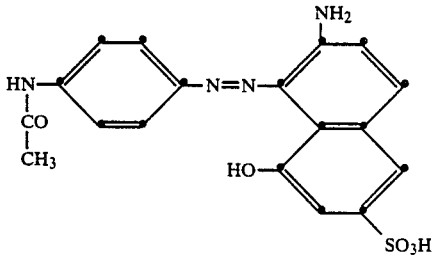
and 80 parts of the red dye
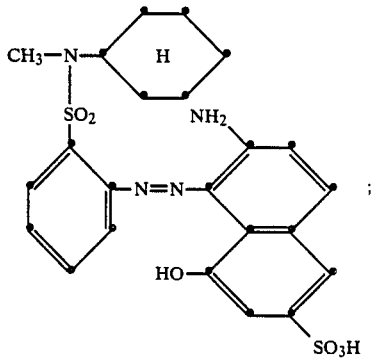
;
a mixture of 20 parts of the red dye
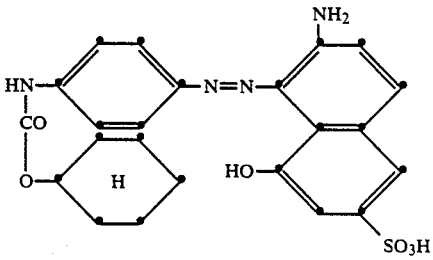
and 80 parts of the red dye

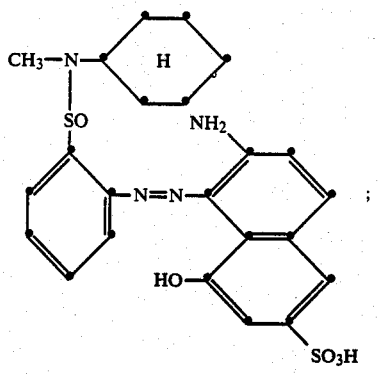
a mixture of 50 parts of the red dye
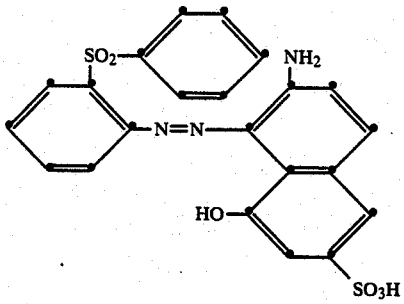
and 50 parts of the red dye
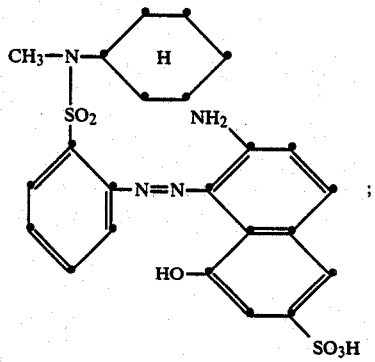
a mixture of 50 parts of the red dye
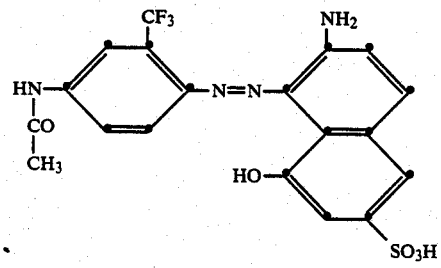
and 50 parts of the red dye
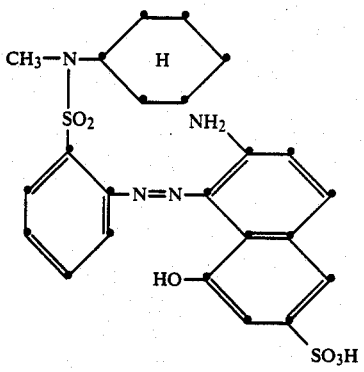
a mixture of 30 parts of the red dye
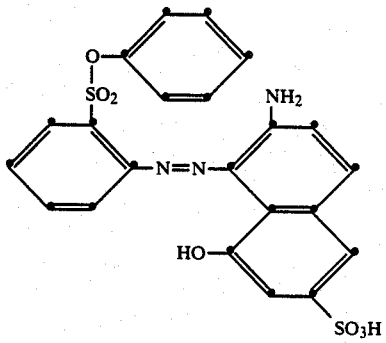
and 70 parts of the red dye
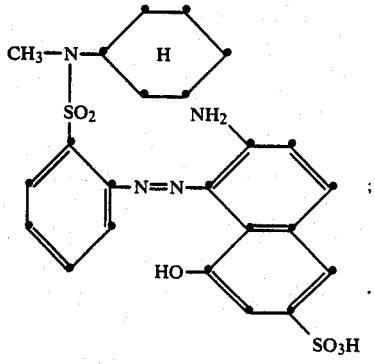
the orange dye of the formula
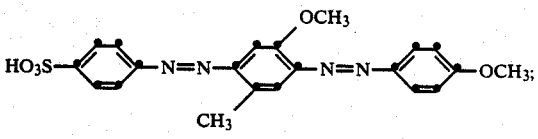
the yellow dyes of the formulae
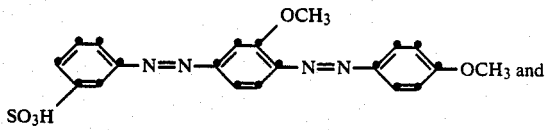

-continued
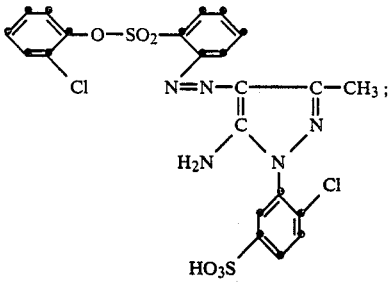
blue anthroquinone dyes of the formulae
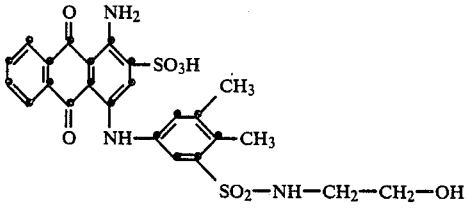
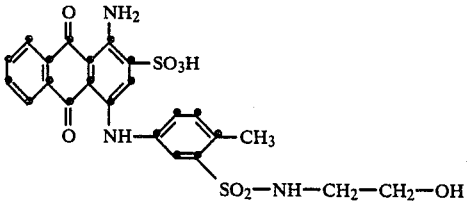
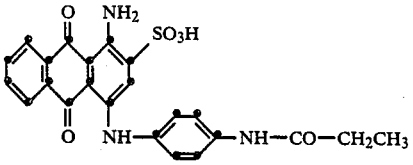
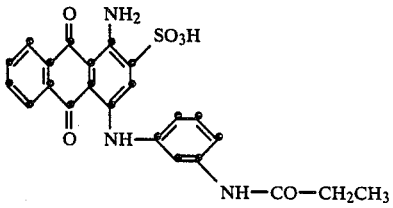
-continued
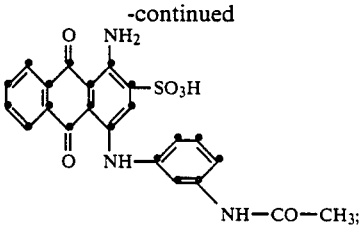
and metal complex dyes such as the yellow 1:2 cobalt complex of
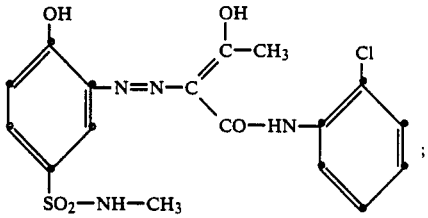
the bordeaux 1:2 cobalt complex of
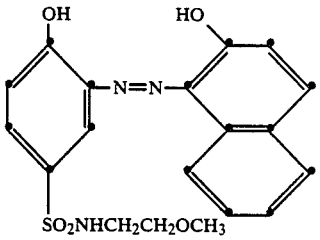
and the black dye obtained on mixing
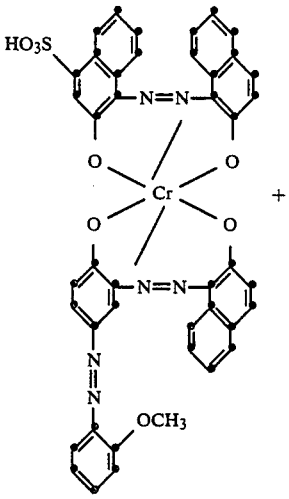
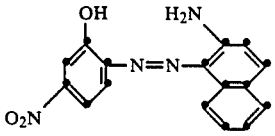
1:2 cobalt complex.
* * * * *

US004790043B1

REEXAMINATION CERTIFICATE (3240th)

United States Patent [19] [11] B1 4,790,043

Chappell [45] Certificate Issued Jun. 24, 1997

[54] PROCESS AND APPARATUS FOR APPLYING A CHEMICAL TO A TEXTILE SUBSTRATE

[75] Inventor: Joseph S. Chappell, Dalton, Ga.

[73] Assignee: Ciba-Geigy Corporation, Ardsley, N.Y.

Reexamination Request:
No. 90/004,364, Sep. 13, 1996

Reexamination Certificate for:

| | |
|---|---|
| Patent No.: | **4,790,043** |
| Issued: | **Dec. 13, 1988** |
| Appl. No.: | **8,131** |
| Filed: | **Jan. 21, 1987** |

Related U.S. Application Data

[63] Continuation of Ser. No. 620,341, Jun. 13, 1984, abandoned, which is a continuation-in-part of Ser. No. 536,761, Sep. 27, 1983, abandoned.

[51] Int. Cl.[6] ..... D06B 5/02

[52] U.S. Cl. ..... 8/151; 8/158; 8/641; 8/924

[58] Field of Search ..... 8/151, 158, 924, 8/149.2, 149.1, 549, 641; 68/5 E, 5 D, 5 C, 62, 205 R

[56] References Cited

U.S. PATENT DOCUMENTS

| | | | |
|---|---|---|---|
| 4,485,508 | 12/1984 | Otting | 8/151 |
| 4,501,038 | 2/1985 | Otting | 8/151 |
| 4,580,304 | 4/1986 | Otting et al. | 8/151 |

OTHER PUBLICATIONS

File Wrapper for U.S. abandoned application Ser. No. 06/585,439.

*Primary Examiner*—Frankie L. Stinson

[57] ABSTRACT

A chemical, such as a dye, is applied to a textile substrate, such as carpet, by continuously moving the substrate past an application position. At the application position a liquid formulation containing the chemical, heated to a temperature below the boiling point thereof, is sprayed toward the substrate, thereby driving the chemical into the substrate. The temperature of the spray is controlled such that the dye contacts the substrate at a temperature sufficient to achieve substantially instantaneous fixation.

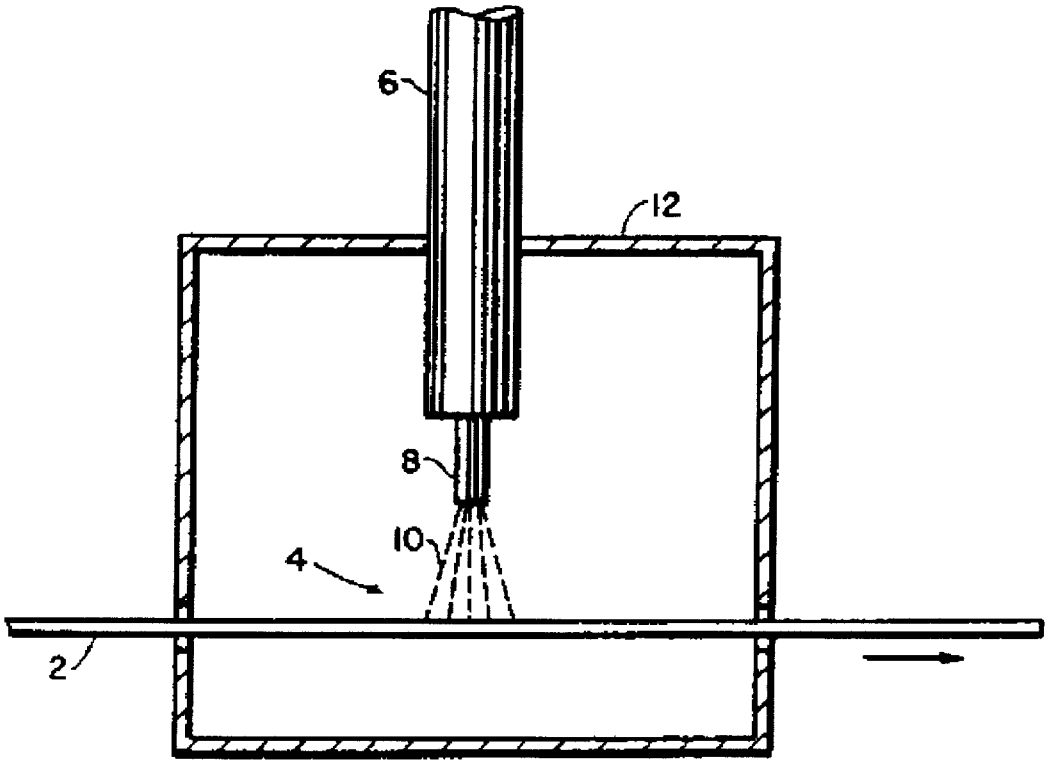

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–10 and 11 is confirmed.

* * * * *